US006302770B1

(12) United States Patent
Aiyer

(10) Patent No.: US 6,302,770 B1
(45) Date of Patent: Oct. 16, 2001

(54) IN-SITU PAD CONDITIONING FOR CMP POLISHER

(75) Inventor: Arun A. Aiyer, Fremont, CA (US)

(73) Assignee: Nikon Research Corporation of America, Belmont, CA (US)

( * ) Notice: Subject to any disclaimer, the term of this patent is extended or adjusted under 35 U.S.C. 154(b) by 0 days.

(21) Appl. No.: 09/123,946

(22) Filed: Jul. 28, 1998

(51) Int. Cl.[7] ..... B24B 1/00
(52) U.S. Cl. ..... 451/56; 451/287; 451/41
(58) Field of Search ..... 451/56, 41, 72, 451/285–289

(56) References Cited

U.S. PATENT DOCUMENTS

| | | | | |
|---|---|---|---|---|
| 5,569,062 | * | 10/1996 | Karlsrud | 451/285 |
| 5,626,509 | * | 5/1997 | Hayashi | 451/56 X |
| 5,779,521 | * | 7/1998 | Muroyama et al. | 451/56 |
| 6,004,197 | * | 12/1999 | Nagahara et al. | 451/56 X |

FOREIGN PATENT DOCUMENTS

| | | | |
|---|---|---|---|
| 64-2858 | 1/1989 | (JP) | B24B/37/00 |
| 1-51267 | 2/1989 | (JP) | B24B/37/06 |
| 07297152 | 11/1995 | (JP) | H01L/21/304 |
| 08148453 | 6/1996 | (JP) | H01L/21/304 |
| 08153692 | 6/1996 | (JP) | H01L/21/304 |
| 08187657 | 7/1996 | (JP) | B24B/37/04 |

* cited by examiner

*Primary Examiner*—Joseph J. Hail, III
*Assistant Examiner*—Anthony Ojini
(74) *Attorney, Agent, or Firm*—Skjerven Morrill MacPherson LLP; Norman R. Klivans; Gregory T. Powell

(57) ABSTRACT

An apparatus and method for conditioning a pad used for chemical-mechanical planarization (CMP) are provided, that allow the conditioning to be performed in situ without stopping the polishing. A retractable pad-conditioning structure, e.g., conditioning tips, is positioned along the bottom perimeter of a wafer carrier. While polishing a surface of a wafer held in the middle of the wafer carrier, whenever the removal rate drops below a permissible value, the pad-conditioning structure, which rotates in unison with the wafer carrier, is lowered to contact the pad to condition the pad's surface. Since an area of the pad used for polishing the wafer is always surrounded by already conditioned pad areas and the area for polishing moves as the wafer carrier moves around on the pad surface, a substantially uniform removal rate is maintained. When the pad is sufficiently conditioned, the conditioning structure is retracted until the pad needs to be conditioned again.

18 Claims, 3 Drawing Sheets

IN-SITU PAD CONDITIONING FOR CMP POLISHER

FIELD OF THE INVENTION

This invention relates generally to chemical-mechanical planarization (CMP) and, in particular, to the pad conditioning aspect of CMP.

BACKGROUND OF THE INVENTION

Chemical-mechanical planarization (CMP) is a well known process used in semiconductor fabrication to polish a surface, for instance a dielectric film surface formed on a silicon wafer or other workpiece. The CMP process removes small elevated features on the surface without significantly thinning the film on, for instance, the flat areas lower than the elevated features.

As shown in a cross-sectional front view (FIG. 1), a typical CMP system uses a flat, rotating disk ("platen" 112) with a pliable polishing pad 110 mounted on its upper surface 112S. As platen 112 is rotated, a slurry (not shown) is deposited near the center of the pad's surface 110S and spread outward using, at least in part, centrifugal force caused by the rotation. A wafer 106 (or substrate), held by a carrier 102 positioned above pad 110, is then pressed downward against pad's surface 110S such that the rotating polishing pad 110 moves the slurry over the wafer's surface 106S. In this manner, elevated spots of the wafer surface 106S are removed and a substantially planar surface is achieved. It is to be noted that although pad surface 110S is illustrated as a smooth surface for simplicity of illustration, in fact pad 110 has a rather roughly textured surface 110S to be rubbed against wafer surface 106S along with the acidic (or basic) slurry containing abrasives.

Pad 110 is made of, e.g., polyurethane impregnated felt, cast and sliced polyurethane with filler, cast and sliced polyurethane without filler, or composite of two or more types of pad material. For effective polishing, the pad's surface 110S needs to have a flat or bell-shaped profile. After a certain period of CMP polishing, the profile of the pad's surface 110S is altered to be no longer useful for polishing, resulting in inefficient and sometimes even ineffective polishing. Deterioration of the profile happens as the pad surface loses its rough texture through mesa formation. Therefore, to maintain the quality of planarization, pad's surface 110S needs to be rejuvenated (i.e., a desirable profile of surface 110S restored) once in a while by, for example, raising the naps of surface 110S by scraping surface 110S.

One problem with prior art pad rejuvenation is that it has to be done "off-line" and ex situ, i.e., either before or after the polishing event with the wafer removed from the polishing station, reducing the throughput of the polishing process. Another problem with prior art pad rejuvenation (which is performed ex situ) is that a uniform removal rate is not maintained, since areas of pad surface 110S are conditioned only in the beginning of the polishing process and, as areas of pad surface 110S are used one or more times for polishing, the removal rates of those areas gradually drop.

SUMMARY

In accordance with the present invention, an apparatus and method for rejuvenating a polishing pad in situ without interrupting the CMP (or other types of) polishing are disclosed. Embodiments of the present invention achieve uniform removal rate and a higher throughput relative to prior art pad conditioning which cannot be performed during the CMP polishing.

In one embodiment, the inventive apparatus includes a wafer carrier carrying a wafer facing down a platen on which a polishing pad is placed. Along the bottom perimeter of the carrier are a number of conditioning tips, which are retractable upward in the direction normal to the upper surface of the platen by, say for example, spring loaded mechanism known to a person skilled in the art. During the polishing of the wafer surface (which faces the pad on the platen), the wafer carrier rotates in one direction and the pad on the platen rotates in the same or other direction. When the removal rate of the polishing process drops below a permissible value (i.e., the surface of the pad needs conditioning), the retractable tips attached to the rotating wafer carrier are lowered onto the pad to start conditioning the pad. The conditioning tips are pushed against the pad by air pressure so that the tips, while in constant contact with the pad, flexibly conform to the varying topography of the pad surface.

When the surface of the pad is sufficiently conditioned, the retractable tips are raised from the pad to stop conditioning. Later, whenever the state of the pad surface deteriorates after a period of polishing, the process of lowering the tips to condition the pad and raising the tips when the pad surface is conditioned is repeated.

DETAILED DESCRIPTION

Figure 1:
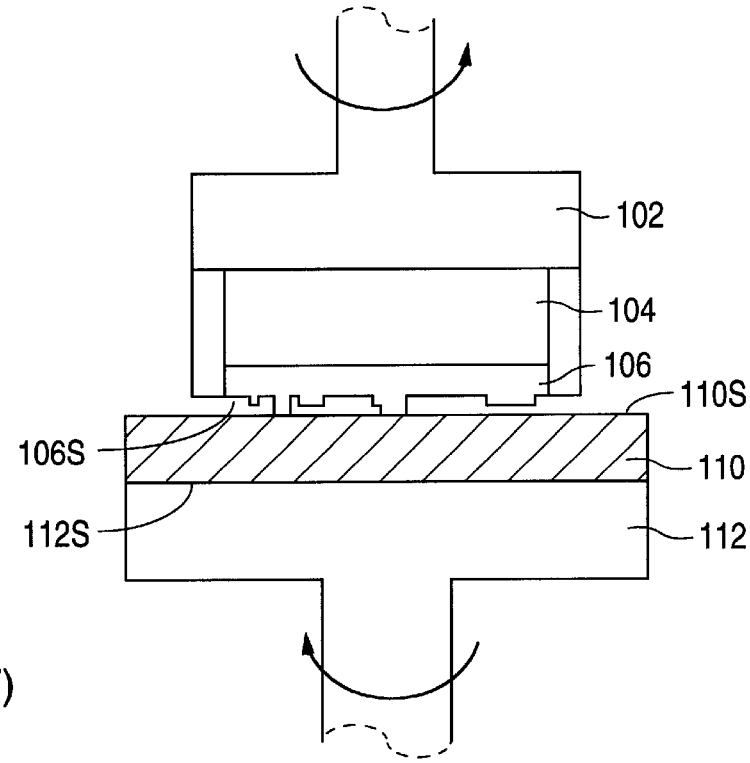
FIG. 1 (PRIOR ART)
FIG. 1 illustrates a cross-sectional front view of a prior art wafer carrier and platen with a CMP pad.
Figure 2:
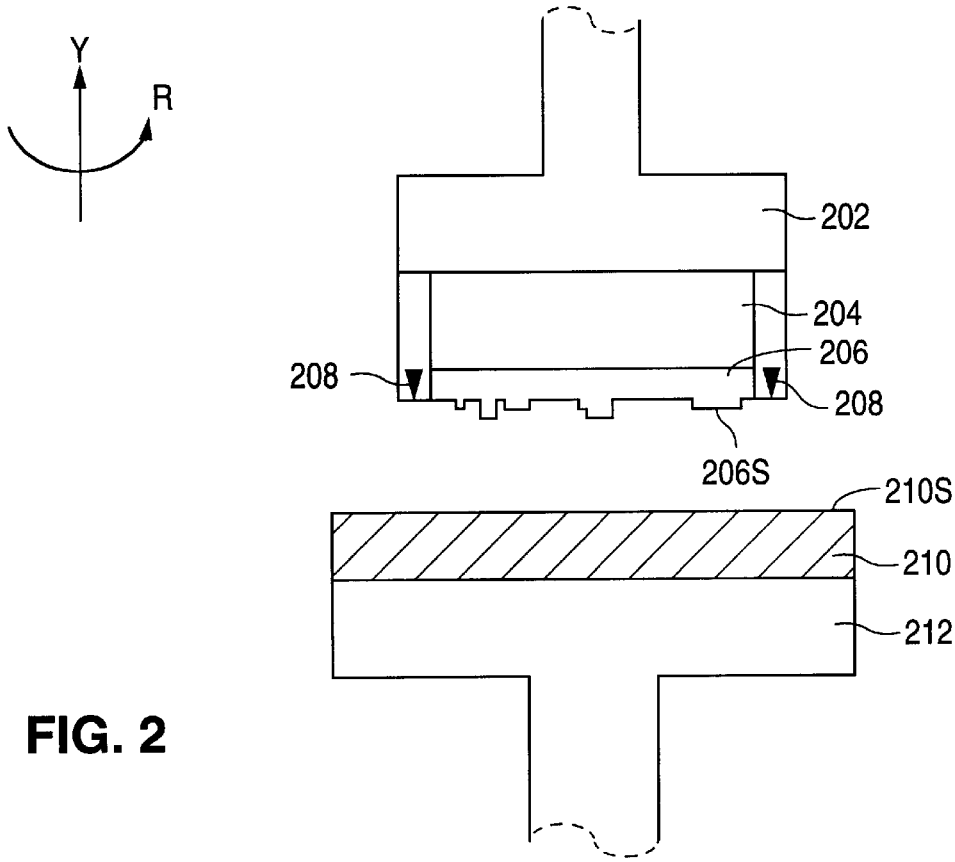
FIG. 2 illustrates, in accordance with the present invention, a cross-sectional front view of a wafer carrier and platen with a CMP pad in one embodiment, where the wafer carrier is lifted from the platen.

In accordance with the present invention, FIG. 2 shows a cross-sectional front view of one embodiment of a wafer carrier 202, with a conditioning structure 208, holding a wafer (workpiece) 206 under a carrier insert 204, where carrier 202 is positioned above a pad 210 laid on top of a platen 212. FIG. 2 shows a state wherein wafer carrier 202 is sufficiently lifted from platen 212 so that neither of a surface 206S of wafer 206 or conditioning structure 208 are in contact with pad surface 210S. It is to be noted that although pad surface 210S in FIGS. 2, 3A–3C, 4 and 5 is shown as a smooth surface for simplicity of illustration, in fact pad surface 210S is conventionally a rather roughly textured surface for polishing.

Figure 4:
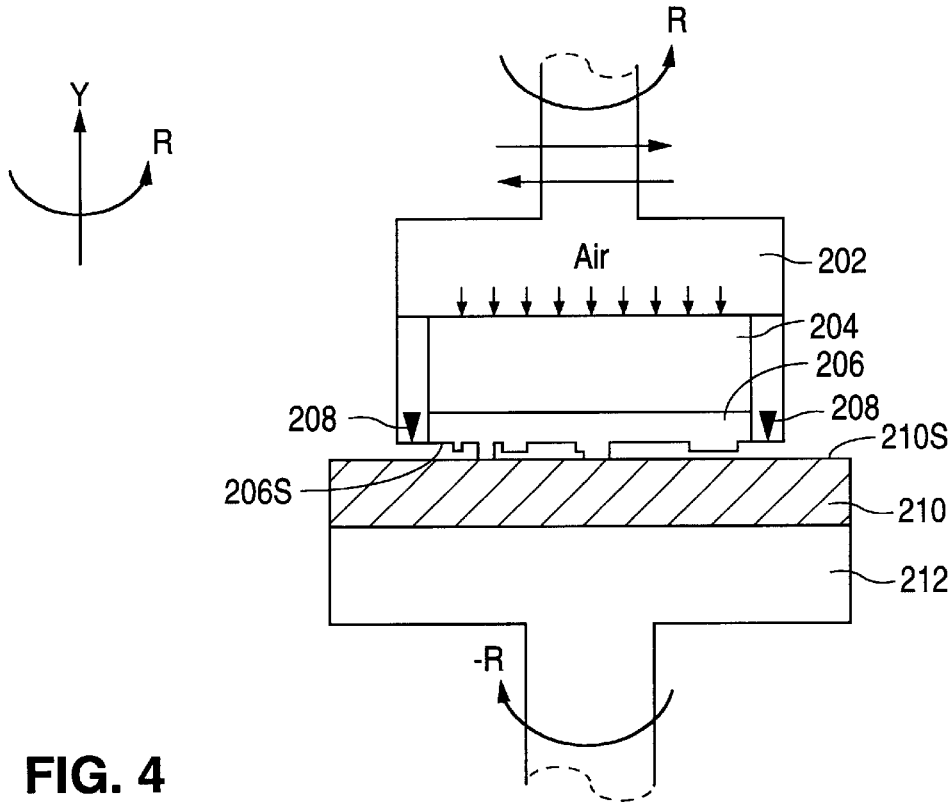
FIG. 4 illustrates a cross-sectional front view of the embodiment of FIG. 2, where the conditioning tips are retracted while the wafer surface is in contact with the pad surface for polishing.
Figure 5:
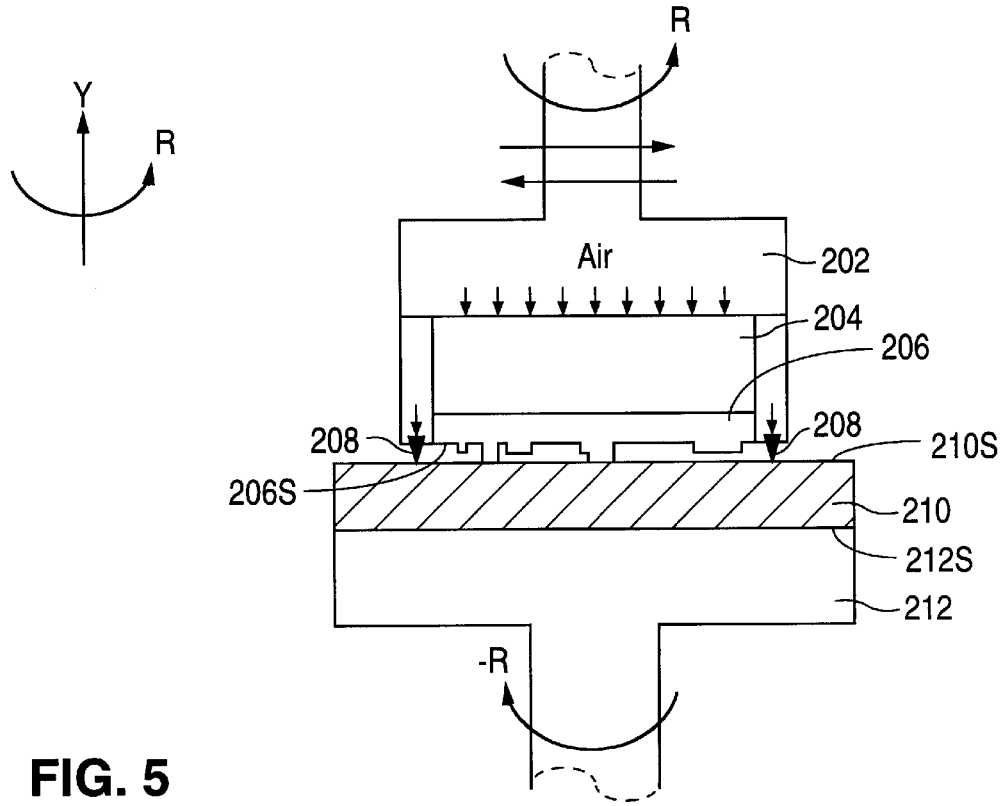
FIG. 5 illustrates a cross-sectional front view of the embodiment of FIG. 2, where the pad is being conditioned while the wafer surface is being polished.

The Y-R coordinate in the upper left-hand side corner of FIGS. 2, 4 and 5 denotes that upward direction is the positive Y direction, and counterclockwise direction (when looking down at the apparatus) is the positive R (rotational) direction. Conditioning structure 208, defining a ring structure, is retractable in the positive Y direction and placed along the bottom perimeter of wafer carrier 202. Mechanisms to retract and lower conditioning structure 208 are known to a person skilled in the art. For example, conditioning structure 208 is in the retracted position using springs when no power is supplied, and pushed down to the lowered position using air pressure or by one or more motor drives. Although a cross-section of conditioning structure 208 is shown to be wedge-shaped in this embodiment, the cross-section can be shaped differently as long as scraping pad surface 210S with the bottom tips of conditioning structure 208 performs effective conditioning.

Figure 3A:
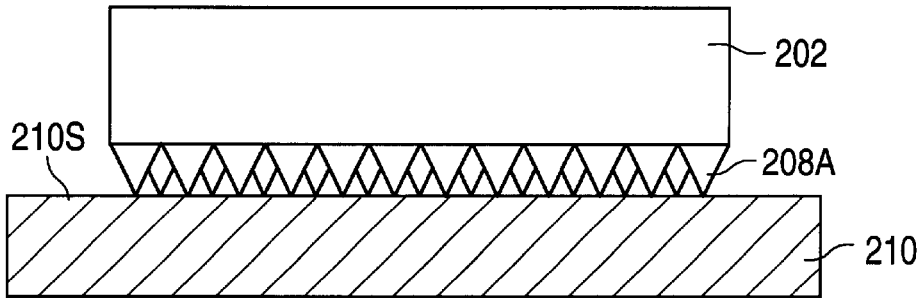
FIG. 3A illustrates a front view of a conditioning structure (attached to a wafer carrier) in contact with the pad in the embodiment of FIG. 2, where the conditioning structure has multiple tips.
Figure 3B:
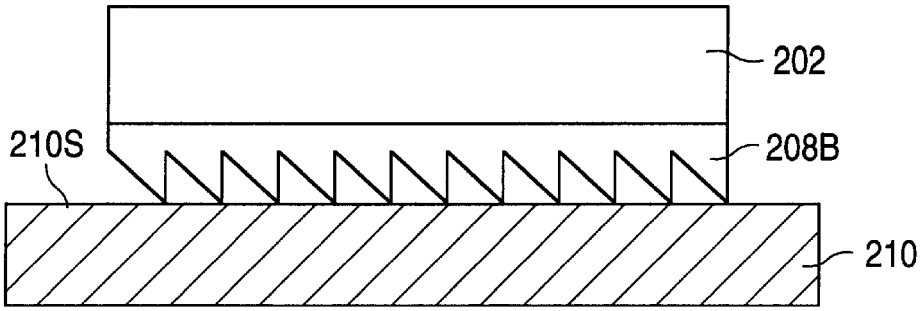
FIG. 3B illustrates a front view of a conditioning structure (attached to a wafer carrier) in contact with the pad in the embodiment of FIG. 2, where the conditioning structure has a serrated blade.
Figure 3C:
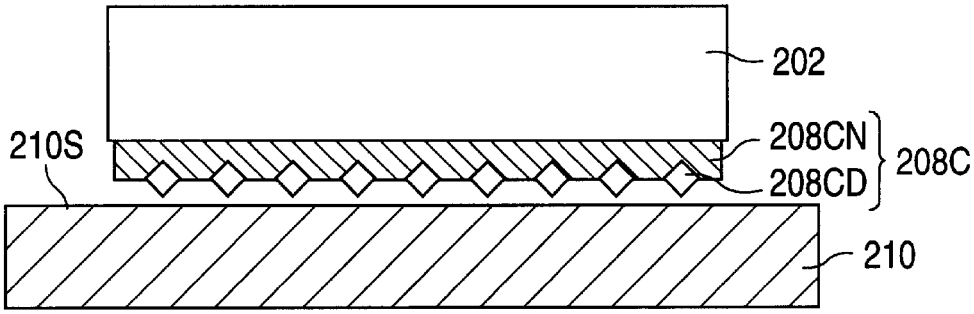
FIG. 3C illustrates a front view of a conditioning structure (attached to a wafer carrier) in contact with the pad in the embodiment of FIG. 2, where the conditioning structure has a nickel film with embedded diamond grit.

FIGS. 3A, 3B and 3C respectively illustrate three different embodiments 208A, 208B and 208C of conditioning structure 208 (in an enlarged front view) attached to wafer carrier 202 and in contact with pad surface 210S. FIGS. 3A, 3B and 3C respectively illustrate conditioning structure 208 having conditioning tips 208A, a serrated blade 208B, and a nickel film 208CN with protruding embedded diamond grit particles 208CD. In the embodiment of FIG. 3A with conditioning tips 208A, each of the tips is movable independently in the Y direction so that the ends of the tips conform to the changing topography and texture of pad surface 210S. Besides using one of the three embodiments of conditioning structure. 208, more than one embodiment can be used simultaneously for pad conditioning. For example, the embodiment of serrated blade 208B can be used along with the embodiment 208C including nickel film and diamond grit.

As shown in FIG. 4 (another cross-sectional front view of the embodiment of FIG. 2), the CMP polishing is initiated by rotating wafer carrier 202, for example, in the positive R direction and lowering wafer carrier 202 (in the negative Y direction) to the point where wafer surface 206S is pressed against the top surface 210S of pad 210. Air pressure (denoted by a number of downward arrows above carrier insert 204) is supplied within wafer carrier 202 and via the carrier insert 204 the downward force due to air pressure is transmitted to wafer 206 so that wafer surface 206S and pad surface 210S are pressed against each other with a force sufficient to enable CMP polishing without damaging wafer 206. Note that, in FIG. 4, although CMP polishing is proceeding (i.e., wafer surface 206S is in contact with pad surface 210S), retractable conditioning structure 208 is in its retracted position, not in contact with pad surface 210S.

After a certain period of CMP polishing (e.g., after polishing a number of wafers), the profile of pad surface 210S deteriorates, resulting in drop of removal rate (usually measured in Å/minute), i.e., inefficient CMP polishing. The deterioration of surface 210S happens in several forms including the naps of surface 210S being polished away thus forming mesas. Drop of removal rate can be detected by methods known to a person skilled in the art. Several points in time can be selected to initiate conditioning of surface 210S, including: (1) immediately after a preset length of polishing time, (2) immediately after a preset number of wafers being polished, (3) as soon as the removal rate drops under a preset value, or (4) when the polishing starts (i.e., simply from the beginning of polishing).

When it is the time to condition pad surface 210S (choosing whichever point in time to start conditioning), conditioning structure 208, attached to now rotating wafer carrier 202, is lowered to contact and condition pad surface 210S as seen in FIG. 5. Besides being rotated, wafer carrier 202 is moved in a plane of motion parallel to platen surface 212S (e.g., back and forth along a diameter of pad surface 210S as denoted by two arrows directed to the left and the right, respectively). The rotational movement and the translational movement of wafer carrier 202 make the entire area of pad surface 210S evenly used for polishing wafer (or workpiece) 206.

In this embodiment, platen 212 also rotates in the direction (denoted "−R") opposite to the direction (denoted "R") in which carrier 202 rotates, to expedite the polishing as well as the pad conditioning. But, in another embodiment, platen rotates in the R direction.

Note that the air pressure is also exerted on conditioning structure 208. In case conditioning structure 208 has conditioning tips 208A, each of conditioning tips 208A is allowed a certain extent of individual movement in the Y direction, and contacts pad surface 210S with variable pressure to flexibly conform to the dynamically changing topography and texture of pad surface 210S while not losing contact with the surface.

Depending on the implementation, two different levels of air pressure (possibly from two pressure mechanisms) may be (directly or indirectly) exerted on wafer 206 and conditioning structure 208, or the same air pressure may be exerted on both. In case two different pressures on conditioning tips 208A are used, in one embodiment, one of the pressures is exerted on a ring structure (not shown) that holds conditioning tips 208A to indirectly exert that pressure on conditioning tips 208A.

After a period of conditioning pad 210, the conditioning process is terminated by retracting the conditioning structure 208 (e.g., conditioning tips 208A or ring structure with a serrated blade 208B) while the polishing process can continue with wafer surface 206S remaining in contact with pad surface 210S. Depending on the implementation, the time to terminate the conditioning process varies, e.g., (1) as soon as the removal rate is raised back to or above a preset adequate value, (2) when the profile of the pad surface 210S is restored to a desired form, or (3) after a preset period of conditioning.

With prior art pad conditioning, the entire surface of the polishing pad is in a conditioned state only at the beginning of a polishing session. As areas of the pad surface are used multiple times for polishing, the areas gradually lose their texture and accordingly the effectiveness for polishing. In contrast, in accordance with the present invention, since the area of pad surface 210S being conditioned always surrounds the area of pad surface 210S used for polishing, and conditioning structure 208 (along with wafer carrier 202) is moved across pad surface 210S, wafer surface 206S is always polished by the areas of pad surface 210S that are in the conditioned state. This aspect brings an advantage that the removal rate is substantially uniform when compared to that of prior art pad conditioning. Another relative advantage is that higher polishing throughput is obtained, since the polishing process need not be stopped whenever pad surface 210S needs to be conditioned.

This disclosure is illustrative and not limiting; further modifications will be apparent to one skilled in the art, in the light of this disclosure, and are intended to fall within the scope of the appended claims.

What is claimed is:

1. A method for rejuvenating a pad used for polishing, the method comprising:

placing a pad on an upper surface of a platen;

placing a workpiece in a carrier so that the workpiece faces the upper surface of the platen;

positioning a conditioning structure along a bottom perimeter of the carrier, the conditioning structure opposing the upper surface of the platen;

rejuvenating an upper surface of the pad using the conditioning structure, the rejuvenating including:

rotating the conditioning structure attached to the carrier by rotating the carrier around an axis normal to the upper surface of the platen;

lowering the carrier so that a surface of the workpiece contacts the upper surface of the pad to polish the surface of the workpiece;

lowering the conditioning structure so that the conditioning structure contacts the upper surface of the pad; and conditioning the upper surface of the pad using the conditioning structure; and raising the conditioning structure from the upper surface of the pad to stop rejuvenating while the polishing is continued.

2. The method of claim 1, wherein the conditioning structure includes a plurality of conditioning tips.

3. The method of claim 2, further comprising:

applying pressure to the tips so that the tips conform to the upper surface of the pad while maintaining contact with the upper surface of the pad during the conditioning.

4. The method of claim 3, wherein the pressure is gas pressure.

5. The method of claim 1, wherein the conditioning structure includes a plurality of serrated blades.

6. The method of claim 1, wherein the conditioning structure includes a film with embedded particles protruding from the surface of the film.

7. The method of claim 6, wherein the conditioning structure further includes a plurality of serrated blades.

8. The method of claim 1, wherein lowering the conditioning structure occurs in response to detecting a predetermined planarization removal rate.

9. The method of claim 1, wherein lowering the conditioning structure coincides with lowering the carrier for polishing.

10. The method of claim 1, wherein lowering the conditioning structure occurs after polishing a predetermined number of workpieces.

11. The method of claim 1, wherein lowering the conditioning structure occurs after polishing for a predetermined time.

12. The method of claim 1, wherein conditioning the upper surface of the pad comprises:

scraping the upper surface of the pad with the conditioning structure to raise naps on the upper surface of the pad.

13. The method of claim 1, wherein the raising is performed when surface removal rate of the workpiece is at least at a predetermined removal rate.

14. The method of claim 1, wherein the raising is performed when a desired profile of the upper surface is restored.

15. The method of claim 1, wherein the raising is performed after rejuvenating the upper surface of the pad has been performed for a predetermined time.

16. The method of claim 1, wherein rejuvenating further includes:

translating the conditioning structure in a plane parallel to that of the upper surface of the platen.

17. The method of claim 1 further comprising stopping polishing by:

raising the carrier; and stopping the rotation of the carrier.

18. The method of claim 1 further comprising:

rotating the pad by rotating the platen.

* * * * *